US006126239A

United States Patent [19]

Hazzard

[11] Patent Number: 6,126,239

[45] Date of Patent: Oct. 3, 2000

[54] READY TO ASSEMBLE FURNITURE CONSTRUCTION INCLUDING FRAMELESS SELF-SUPPORTING PANEL MEMBERS

[75] Inventor: Thomas B. Hazzard, E. Grand Rapids, Mich.

[73] Assignee: Chameleon Studio, Inc., Grand Rapids, Mich.

[21] Appl. No.: 08/843,281

[22] Filed: Apr. 14, 1997

[51] Int. Cl.[7] ..... A47C 7/00

[52] U.S. Cl. ..... 297/440.1; 297/440.12; 160/231.2

[58] Field of Search ..... 297/440.1, 440.12, 297/440.14, 451.11, 451.12, 452.14, DIG. 6; 52/71, 791.1, 783.11; 160/231.1, 231.2

[56] References Cited

U.S. PATENT DOCUMENTS

| | | | |
|---|---|---|---|
| 1,854,663 | 4/1932 | Nebel | 297/440.12 X |
| 3,212,464 | 10/1965 | Steur | 297/440.12 X |
| 3,837,719 | 9/1974 | Barron | 297/440.12 V |
| 3,871,726 | 3/1975 | Stegner | 297/440.12 X |
| 4,085,970 | 4/1978 | Klein | 297/440.12 |
| 4,340,251 | 7/1982 | Geoffroy-Dechaumme | 297/440.12 |
| 4,546,941 | 10/1985 | Hildebrand | 297/440.12 X |
| 4,648,658 | 3/1987 | Calco | 297/440.12 |
| 5,697,675 | 12/1997 | DeWitt et al. | 297/440.12 |

*Primary Examiner*—Peter M. Cuomo
*Assistant Examiner*—Rodney B. White
*Attorney, Agent, or Firm*—Barlow, Josephs & Holmes, Ltd.

[57] ABSTRACT

A ready to assemble furniture construction, such as a chair, includes frameless, self-supporting panel members which easily collapse into a flat configuration and expand into a self-supporting volumetric structure. In a preferred chair construction, a seat panel, back panel, and a skirt panel are supported between two, spaced panel members each of which are defined by two like-shaped flexible sheets which are secured together in a predetermined configuration which allows the sheets to expand from the flat configuration to their self-supporting volumetric form. Each of the sheets forming the panel member is generally square and has four generally linear peripheral edges which are secured together to form a closed panel structure. The sheets further include arcuate, inwardly curved, living hinges extending along the length of each peripheral edge of the sheet. In use, the panel structure is movable between a flat collapsed condition, and an expanded, self-supporting volumetric condition wherein the central body portions of the sheets are flexed into a convex shape and maintained in spaced apart relation by the adjacent hinged edge portions which are flexed inwardly into a generally concave shape and extend generally perpendicular to the body portions. Expanding the panel structure from the collapsed condition to the volumetric form is accomplished by simply pressing inwardly on the peripheral edges of the panel structure. Inward pressure forces the peripheral edges of the sheet inwardly while also flexing the main body portions apart and outwardly into their convex shape. The curved living hinges extending between the body portion and edge portions lock the structure in complementary self-supporting tension and compression to automatically maintain the shape of the structure.

35 Claims, 6 Drawing Sheets

READY TO ASSEMBLE FURNITURE CONSTRUCTION INCLUDING FRAMELESS SELF-SUPPORTING PANEL MEMBERS

BACKGROUND AND SUMMARY OF THE INVENTION:

The instant invention relates to furniture constructions, and more particularly to a ready to assemble furniture construction including a frameless, yet self-supporting panel member which forms the structural support for the furniture construction.

Ready to assemble furniture constructions have heretofore been known in the art. While the existing furniture constructions are effective, there are a number of drawbacks which prevents them from having a major presence in the mass market. In general, the key to a successful ready to assemble furniture construction is to have the highest perceived value at the lowest possible cost. One factor which has added to the cost of prior systems is that furniture requires some sort of rigid structural member for support. The prior art has primarily relied on wood or metal frames to provide that rigidity. However, wood and metal frames are expensive, and they are difficult to design so that they collapse effectively for storage and shipping. Another drawback relating to wood and metal frame ready to assemble furniture is that the construction usually requires tools to assemble and disassemble the frame at the point of set-up. Other prior art assemblies have been constructed from preformed sheet materials which are slotted and tabbed together to create lightweight inexpensive self-supporting structures. While these structures are extremely easy to manufacture and assemble, the bulky and crude aesthetic appearance of these prior designs has detracted from their widespread commercial acceptance. Accordingly, it is believed that a new and improved ready to assemble furniture construction system, including new types of structural members, is needed in the industry.

The instant invention provides a ready to assemble furniture construction, such as a chair, including frameless, self-supporting panel members which are expandable from a flat configuration into a self-supporting volumetric structure. In a preferred chair construction as described herein, a seat panel, back panel, and a skirt panel are secured to and supported between two, spaced panel members. The panel members, seat, panel, backrest panel, and skirt panel are secured together in a configuration which allows all of the panels to be folded in overlying relation such that the total thickness of the entire assembly, when collapsed, is only about one inch. Each of the panel members is constructed from two like-shaped flexible sheets which are secured together in a predetermined configuration that allows the sheets to expand from the flat configuration to their self-supporting volumetric form, and vice versa, from their volumetric form back to the flat configuration. Each of the sheets forming a panel member is generally square and has four linear peripheral edges which are secured together to form a closed panel structure. The most critical aspect of the sheet configuration is the provision of selectively placed living hinges which allow the sheets to bend in a predefined configuration. More specifically, the sheets include arcuate, inwardly curved living hinges which extend along the length of each peripheral edge of the sheet. The living hinges divide the sheets into a central body portion and a plurality of edge portions extending along a corresponding peripheral edge. These living hinges give the sheets the ability to either lay flat or to "pop" out into a self-supporting volumetric form, as will hereinafter be described.

In use, the panel member is movable between a flat, collapsed condition, and an expanded, self-supporting volumetric condition. In the expanded condition, the central body portions of the sheets are flexed into a generally convex shape and maintained in spaced apart relation by the adjacent, hinged edge portions which are flexed inwardly into a generally concave shape. Expanding the panel structure from the flat condition to the expanded volumetric form is accomplished by simply pressing inwardly on the peripheral edges of the panel structure. Inward pressure forces the outer peripheral edges of the sheets inwardly, and forces the edge portions into a concave shape, i.e. so that the edge portions extend generally perpendicular to the connected body portion along the living hinges. The inward movement of the edge portions also flexes the central body portions apart and outwardly into their convex shape. The curved living hinges extending between the body portion and edge portions lock the structure in complementary self-supporting tension and compression to automatically maintain the shape of the structure. The resulting structure has tremendous strength in longitudinal compression. The panel member is collapsed back to its flat form by pressing the two sheets together, i.e. pressing inwardly in the middle of the central body portions. This motion relieves the forces on the living hinges allowing the edge portions to flex outwardly back to their relaxed position.

In the preferred chair structure as noted above, the rear edges of the panel members are attached to opposite side edges of the back panel. The back panel spaces the structural panel members apart so that they can form the supporting arms/legs of the chair. The rear edge of the seat panel is attached to the middle of the back panel, and the skirt panel is attached to the front edge of the seat panel. The seat and skirt panels are secured in position by strips of hook and pile fabrics which are provided on flaps on the side edges of both the seat and skirt panels, and the inner side walls of the panel members.

Accordingly, among the objects of the instant invention are: the provision of a frameless, yet self-supporting structural panel member for use in ready to assemble furniture and other articles of construction; the provision of a frameless, yet self-supporting structural member formed from seamed sheet materials which are movable from a flat form to a volumetric form; the provision of a frameless, yet self-supporting structural panel formed from facing sheet materials having complementary living hinges; the provision of articles of construction which include the frameless structural panel members as structural support members; and the provision of ready to assemble furniture constructions including the frameless, self-supporting panel members as structural support members.

Other objects, features and advantages of the invention shall become apparent as the description thereof proceeds when considered in connection with the accompanying illustrative drawings.

DESCRIPTION OF THE DRAWINGS:

In the drawings which illustrate the best mode presently contemplated for carrying out the present invention.

Figure 1:
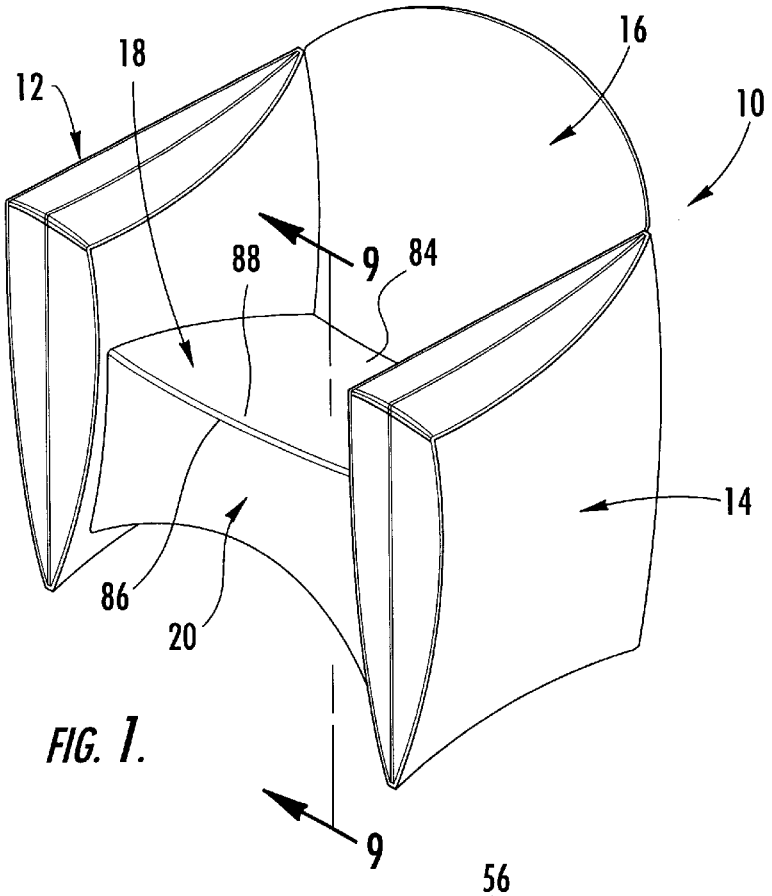
FIG. 1 is a perspective view of a chair construction including a frameless, self-supporting structural panel member in accordance with the teachings of the instant invention.
Figure 2:
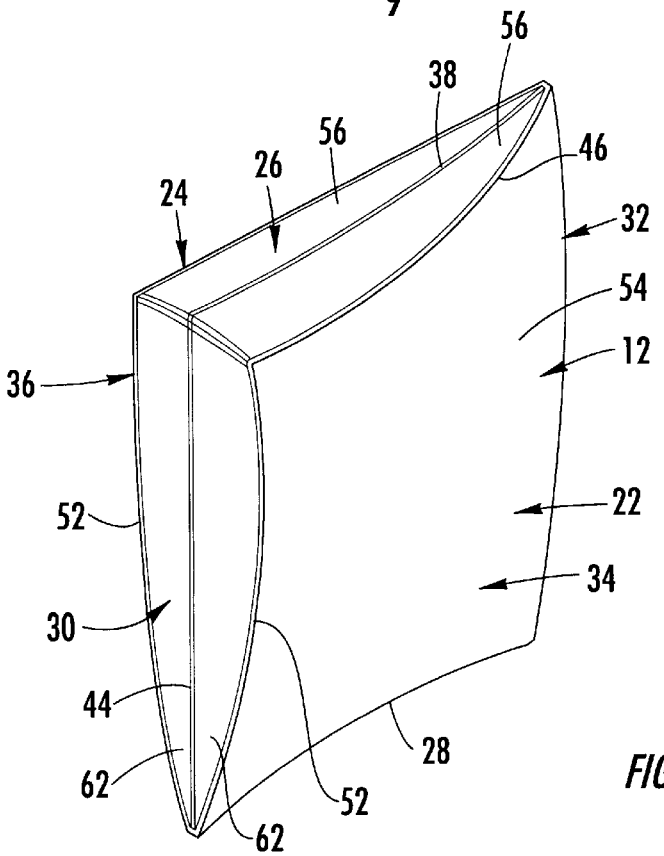
FIG. 2 is a perspective view of the self-supporting panel member which forms the side arm/leg of the chair construction of FIG. 1.
Figure 3:
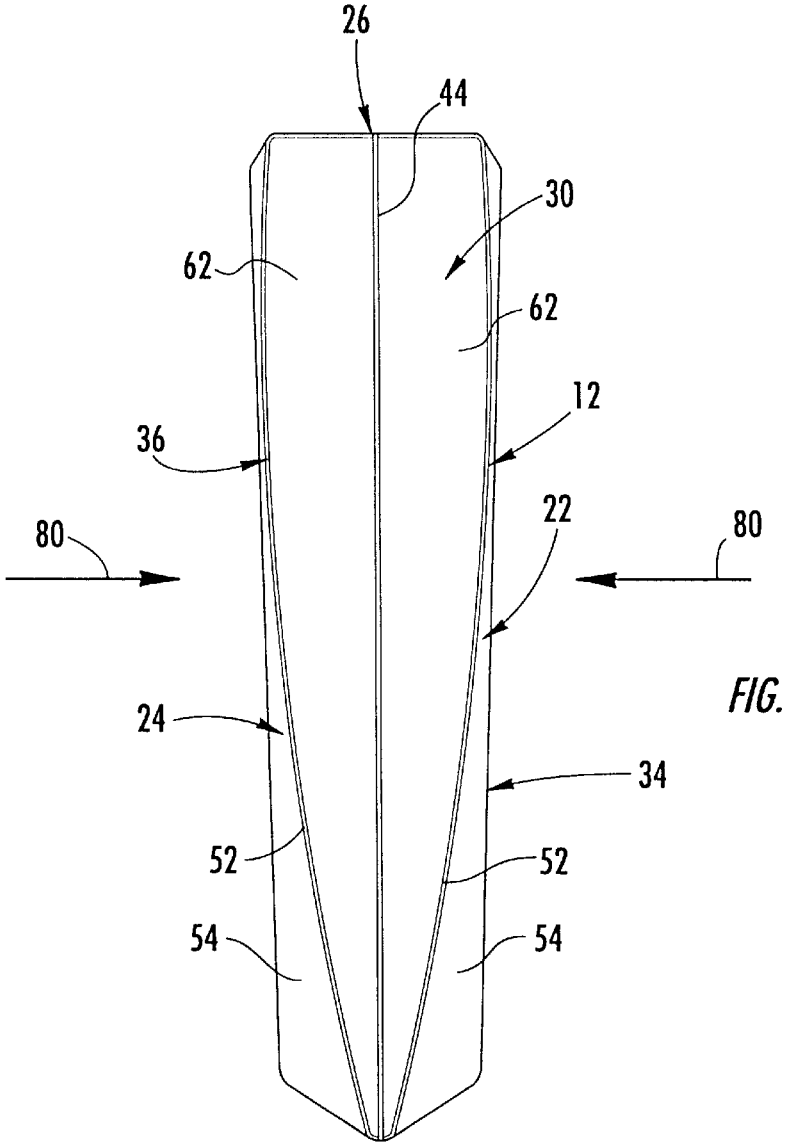
FIG. 3 is a front view of the panel member.
Figure 4:
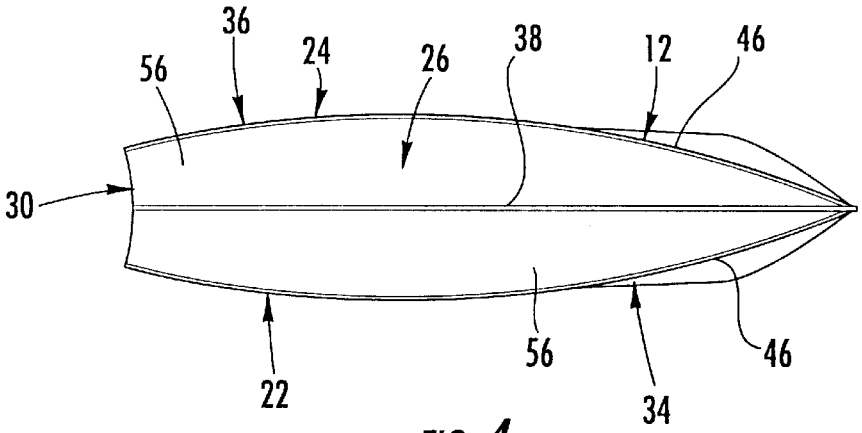
FIG. 4 is a top view thereof.

DESCRIPTION OF THE PREFERRED EMBODIMENT:

Referring now to the drawings, a ready to assembly chair construction in accordance with the teachings of the instant invention is illustrated and generally indicated at 10 in FIGS. 1–10. More specifically, the chair construction 10 comprises first and second frameless, self-supporting panel members generally indicated at 12 and 14 respectively, a back panel generally indicated at 16, a seat panel generally indicated at 18, and a skirt panel generally indicated at. 20 The panel members 12, 14 normally rest in a flat configuration (FIG. 5) and are constructed so as to be able to expand, i.e. "pop", from their normal flat configuration into an expanded volumetric form which has tremendous strength in compression. As will hereinafter be more fully described, the panel members 12, 14 , seat panel 18, back panel 16, and skirt panel 20 are secured together in a configuration which allows all of the panels to be folded in overlying relation whereby the total thickness of the entire assembly 10, when collapsed, is only about one inch.

Both of the frameless panel members 12, 14 are generally identical for purposes of the present chair construction, and in this regard, the following description will be given primarily in reference to panel 12. Referring to FIGS. 2–4, 7 and 8, the panel member 12, when in its expanded, self-supporting condition, is generally square in shape, having first and second side walls generally indicated 22, 24 respectively, and top, bottom, front and back walls generally indicated 26, 28, 30 and 32 respectively. The side walls 22, 24 have somewhat of a convex curve, while the four edge walls 26, 28, 30 and 32 have somewhat of a concave curve. The importance and relevance of the convex and concave shapes will be described in later portions of the text herein.

Figure 6:
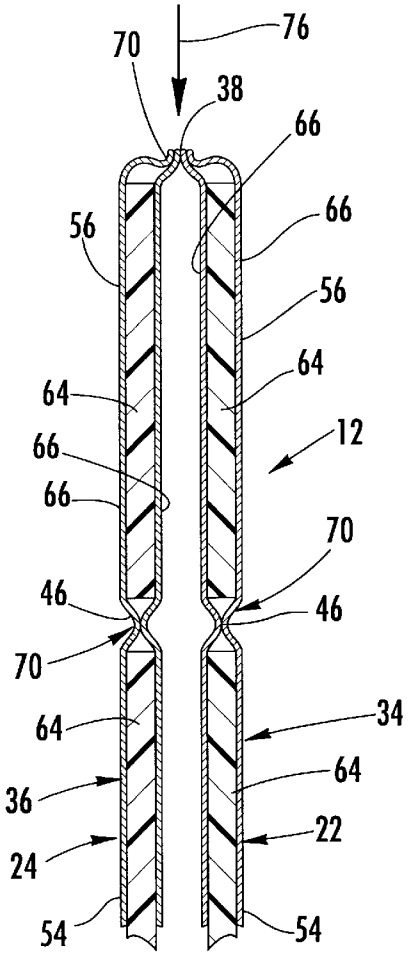
FIG. 6 is a cross-sectional view thereof taken along line 6—6 of FIG. 5.
Figure 5:
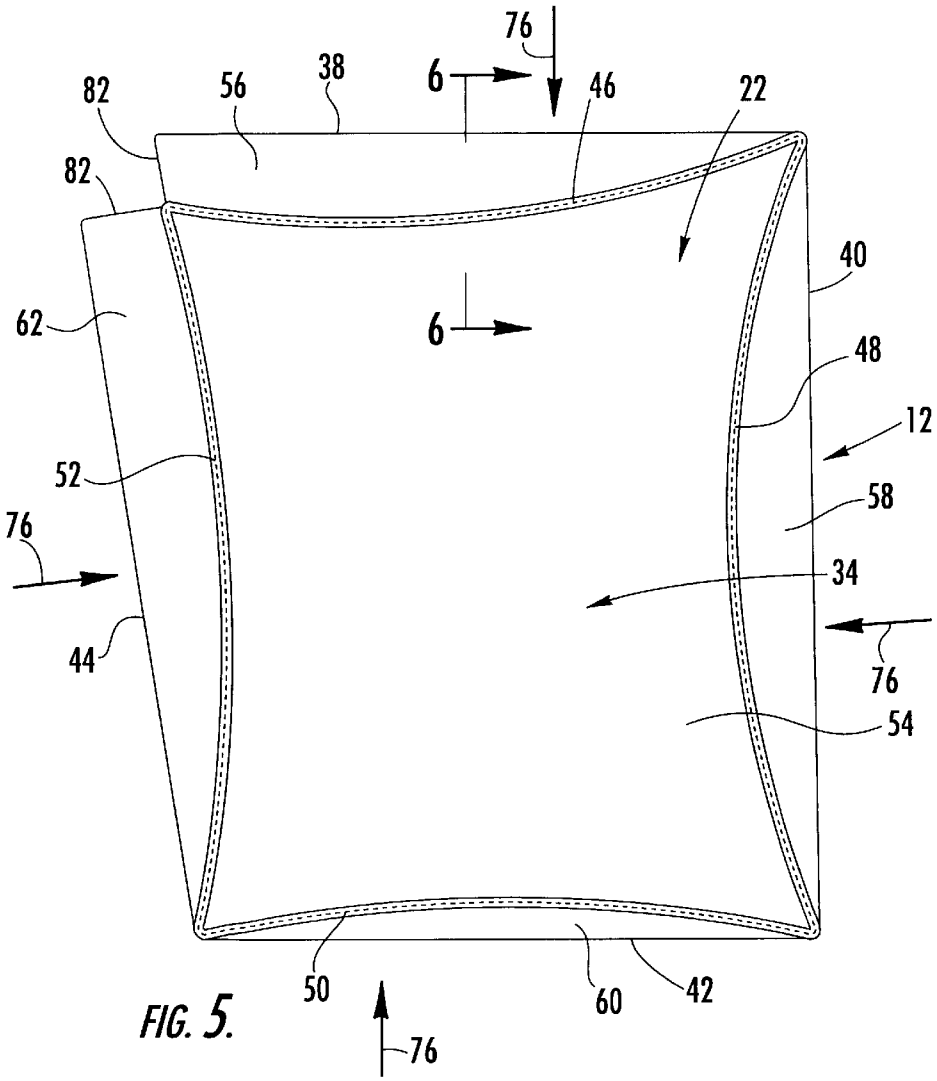
FIG. 5 is a side view of the panel member in a collapsed condition.

Referring now to FIGS. 5 and 6 wherein the panel 12 is shown in its collapsed form, each panel member 12 is generally constructed from two like-shaped flexible sheets generally indicated at 34, 36 respectively, which are aligned in overlying relation and secured together around their peripheral edges. The sheets 34, 36 are generally identical for purposes of the present construction. Each of the sheets 34, 36 is generally square and has four linear peripheral edges 38, 40, 42, and 44 respectively, which are secured together to form the generally square, closed panel member as illustrated. In order to provide the sheets 34, 36 with the ability to bend in a predetermined configuration, the sheets 34, 36 include arcuate, inwardly curved living hinges 46, 48, 50, 52 which extend along the length of each peripheral edge of the sheet 34, 36. The living hinges 46, 48, 50, 52 divide the sheets 34, 36 into a central body portion 54 and a plurality of edge portions 56, 58, 60, 62 the edge portions 56, 58, 60, 62 being substantially planar extensions of the central body portion 54 extending being the living hinges 46,48, 50, 52 and the outer peripheral edges 38, 40, 42, 44 of the sheets. These living hinges 46, 48, 50, and 52 give the sheets 34, 36 the ability to either lay flat or to "pop" out into a self-supporting volumetric form, as will hereinafter be described.

Referring specifically to FIG. 6, the sheets 34, 36 can be fabricated from any type of flexible sheet material such as flexible plastic sheets, relatively thick paperboard materials, cardboard, etc. For purposes of the present invention, wherein the panels 12, 14 are utilized in a furniture construction, it is desirable to have the exterior surface of the sheets comprised of a fabric material so that the panels 12, 14 appear to be upholstered. In this regard, the preferred sheet construction comprises an inner core layer of a flexible plastic sheet material 64 sandwiched between two outer covering layers of a fabric material 66. The sheet plastic 64 preferably has a thickness of about ⅛ to 1/10 inch to provide flexure in bending as well as longitudinal rigidity. More specifically, the inner core layer of flexible plastic 64 is divided into its constituent body pieces, i.e. central body portion and edge portions, along the lines of the living hinges 46, 48, 50, 52. In other words, the main body 54 and edge portions 56, 58, 60, 62 are formed as separate elements and arranged in mating alignment. Sheets of the fabric material 66 are then glued to the opposing surfaces of the flexible plastic 64, and the fabric 66 is seamed (see seam indicator arrows 70 in FIGS. 6 and 8) around and between the plastic pieces 64 to form the edges and living hinges between the pieces. Seaming of the fabric can be accomplished by sewing, heat seaming, or ultrasonic fusing. In this regard, the fabrics used should contain sufficient synthetic fibers for seaming using the heat and ultrasonic seaming methods. The fabric exterior gives the impression of an upholstered structure while the interior plastic elements give the structure rigidity when "popped" into the expanded condition.

Figure 10:
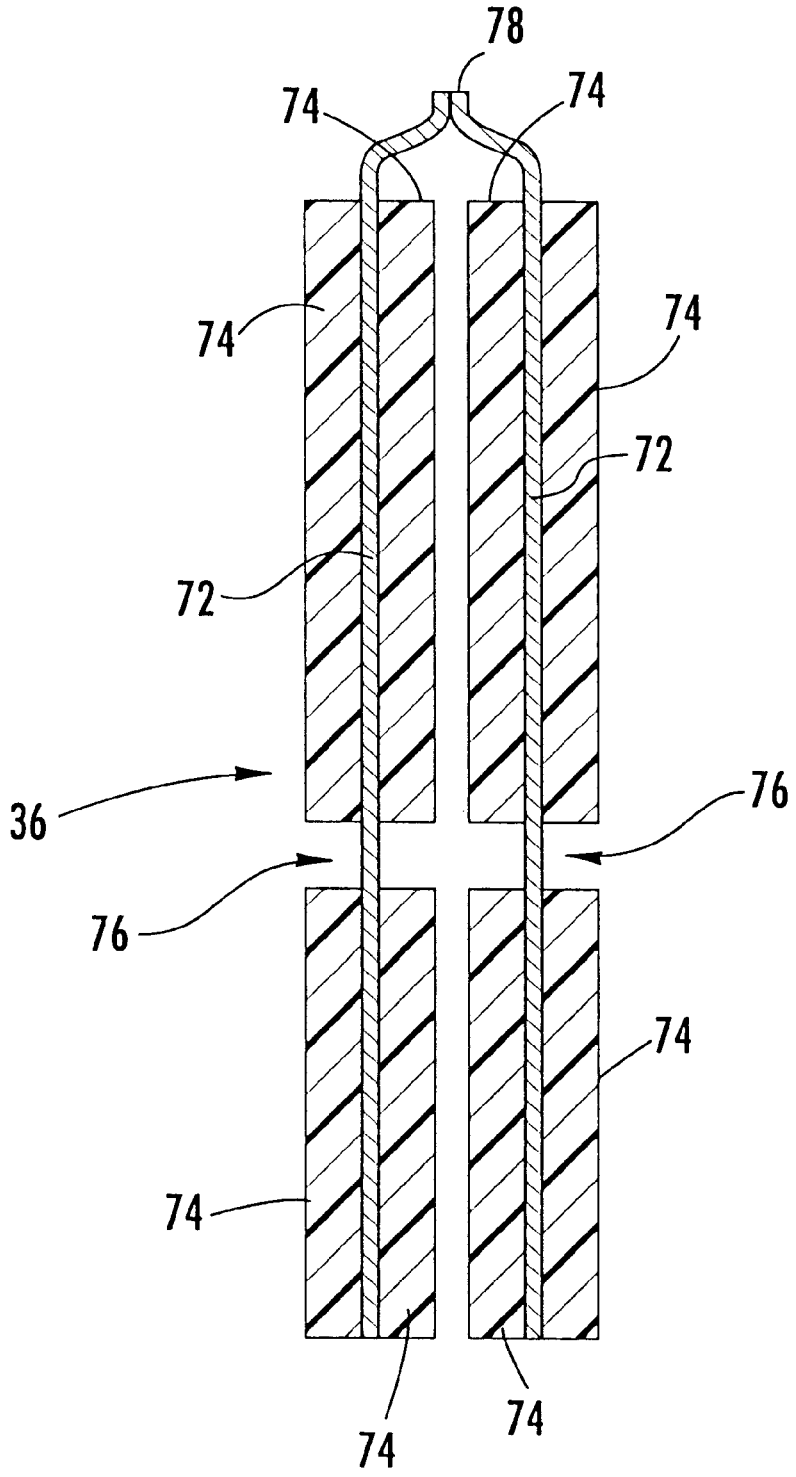
FIG. 10 is a cross-sectional view of collapsed panel member having an alternate sheet construction.

Referring to FIG. 10, the sheets 34,36 (only 36 is shown) might alternatively comprise a central core of fabric material 72 captured facing pieces of plastic 74, the plastic pieces 74 being formed in the same shapes as previously described in the preferred construction. There is no seaming between parts in this construction. The outer plastic pieces 74 will be glued to the inner core of fabric and/or mechanically fastened to each other through the fabric layer 72. The fabric 72 located in the gaps generally indicated 76 between the edges of the plastic pieces 74 form the living hinges. Furthermore, when the fabric layers 72 are seamed at their ends as indicated at 78, these seams also form living hinges at the peripheral edges of the sheets. This particular sheet construction would reduce the amount of fabric material needed (some fabric are very expensive), and would create a smooth, and rigid exterior surface. While not preferred for casual furniture constructions, this type of sheet might be advantageous in other circumstances, such as for children furniture, and for other articles of construction which might have application in situations where the article is exposed to water or other fluids.

Figure 7:
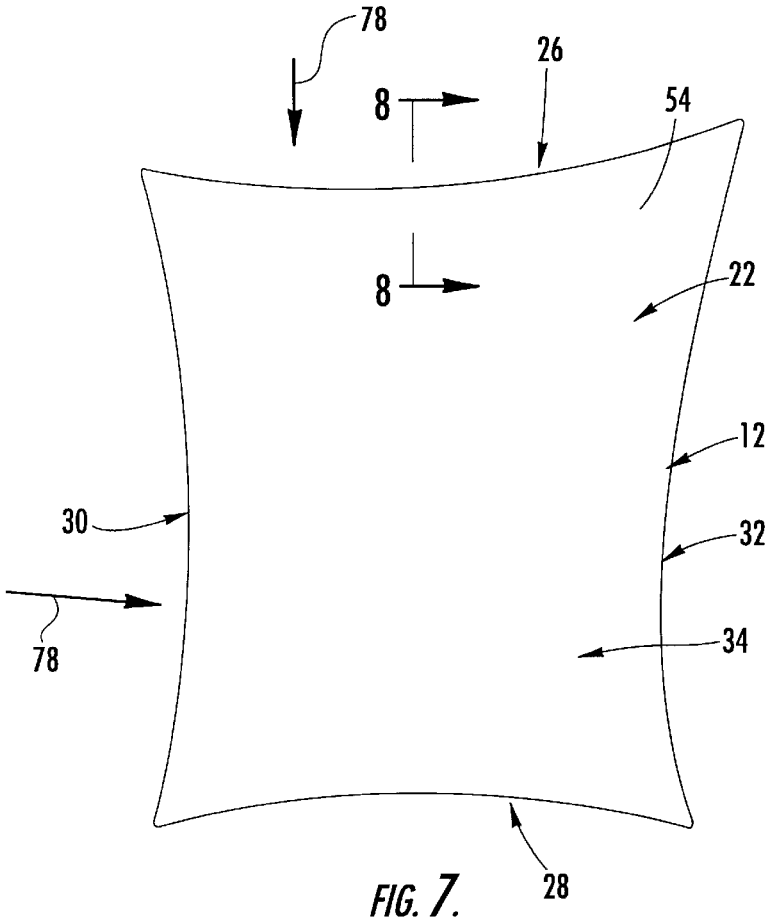
FIG. 7 is a side view of the panel member in an expanded condition.
Figure 8:
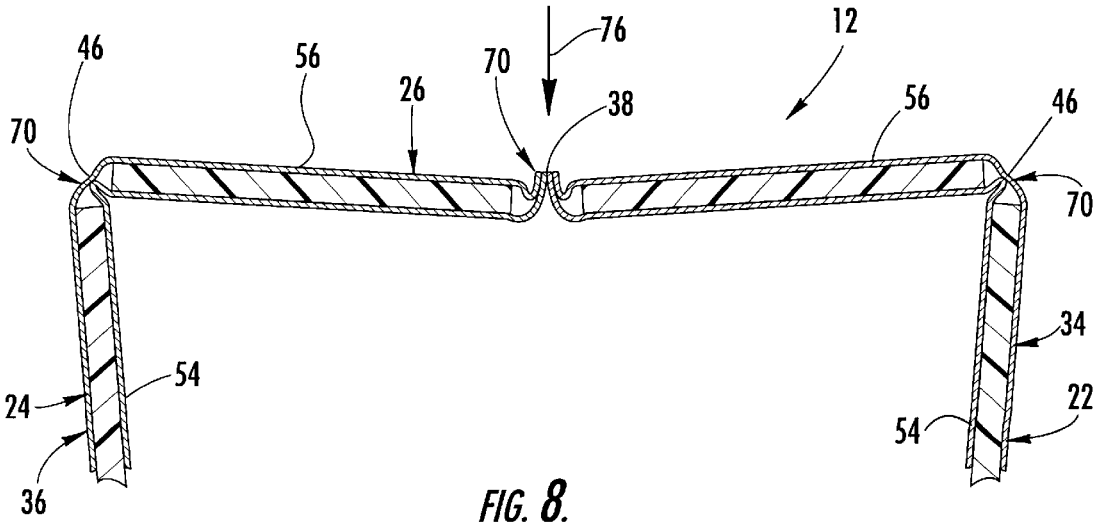
FIG. 8 is a cross-sectional view thereof taken along line 8—8 of FIG. 7.

In use, the panel structure is movable from the normal, flat, collapsed condition (FIGS. 5 and 6), to the expanded, self-supporting volumetric condition (FIGS. 1–4 and 7, 8) simply by pressing inwardly on the peripheral edges 38, 40, 42, 46 of the structure (See . direction arrows 76 in FIGS. 5 and 6). In the expanded condition, the central body portions 54 of the sheets 34, 36 are flexed into a generally convex shape and maintained in spaced apart relation by the adjacent, hinged edge portions 56, 58, 60, 62 which are flexed inwardly into a generally concave shape and extend generally perpendicular to the central body portions 54 (FIGS. 7 and 8). As previously stated, expanding the panel member 12 from the collapsed condition to the volumetric form is accomplished by simply pressing inwardly on the peripheral edges 38, 40, 42, 44 of the panel structure. Inward pressure forces the outer peripheral edges 38, 40, 42, 44 of the sheets 34, 36 inwardly, forcing the complementary edge portions 56, 58, 60, 62 into a generally concave shape, i.e. so that the edge portions 56, 58, 60, 62 extend generally perpendicular to the connected body portion 54 along the living hinges 46, 48, 50, 52 (See FIG. 8). The inward movement of the edge portions 56, 58, 60, 62 also flexes the central body portions 54 apart and outwardly into their convex shape (also See FIG. 8). The curved living hinges 46, 48, 50, 52 extending between the body portion 54 and edge portions 56, 58, 60, 62 and the outer edge hinges (formed at seams 70 around the outer edges) lock the panel 12 in complementary self-supporting tension and compression to automatically maintain the shape of the structure, the resulting structure having tremendous strength in longitudinal compression (See direction arrows 78 in FIG. 7). The panel member 12 is also easily collapsed by pressing the two sheets together, i.e. inwardly in the middle of the central body portion (see direction arrows 80 in FIG. 3). This motion relieves the compressive forces on the living hinges 46, 48, 50, 52 allowing the edge portions 56, 58, 60, 62 to flex outwardly back to their relaxed position.

While the present panel members 12, 14 are described as being generally square or quadrilateral in shape, it is to be understood that the principles of panel construction as herein defined can be easily adapted to a triangular pattern, or other any other pattern with more than four sides. Such structure would need to include corresponding living hinges along each of the peripheral edges. In other words, a triangular pattern having three edges would require three living hinges. Likewise it is to be understood that the edges need not be identical in length, that the edges need not be at 90 degree angles to each other, and that the terminal ends of the edges need not meet in a point to be effective. For example, one corner of the panel structure 12 as illustrated in the drawings includes 90 degree edge corners 82. These corner structures 82 provide a flat edge on the corner of the panel 12 and add thickness to the structure at the corner. In the present embodiment, the flat edge corners 82 are selected to be located at the top front edge of the panel 12 to form the front edge of the arm rest of the chair 10.

Figure 9:
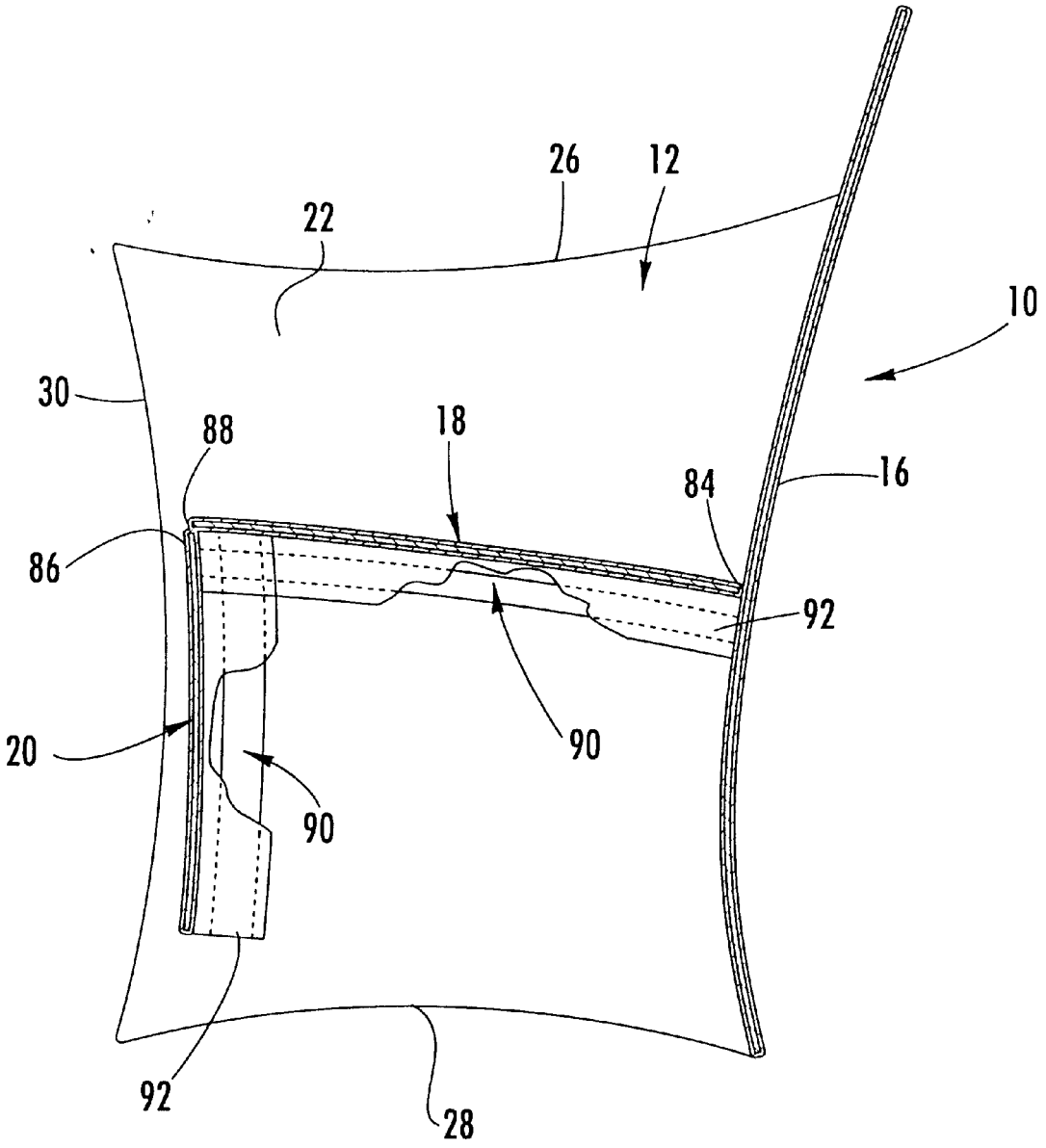
FIG. 9 is a cross-sectional view of the chair construction taken along line 9—9 of FIG. 1.

Turning back to FIGS. 1–4 and 9, the back panel 16, seat panel 18 and skirt panel 20 of the chair construction 10 are each preferably fabricated in accordance with the teachings recited hereinabove, each panel 16, 18, 20 comprising a core sheet of flexible fabric sandwiched between two outer covering layers of fabric. The chair 10 is constructed from these panel members by attaching, i.e. stitching the side edges (not shown) of the back panel 16 to the rear peripheral edge 40 of each of the panel member 12, 14. More specifically, the side edges of the back panel 16 would be stitched directly to the rear peripheral edge seams 40 of the panel 12 thus forming a three piece hinged panel structure with the back panel 16 in the center thereof. Referring to FIG. 9, the rear edge 84 of the seat panel 18 is hinged, i.e. stitched, to a central portion of the back panel 16 and the top edge 86 of the skirt panel 20 is hinged, i.e. stitched, to the front edge 88 of the seat panel 18 whereby the skirt panel 20, seat panel 18 and back panel 16 can be folded in accordion fashion into a flat configuration against the back panel 16. The side edges of the seat panel 18 and skirt panel 20 are releasably securable to the inner side walls of the panel members 12, 14 by means of hook and pile fabric strips generally indicated 90 attached to flaps 92 on the side edges of the seat panel 18 and skirt panel 20, and on the inner side walls of the panel members 12, 14.

To collapse the chair 10 from its assembled condition as shown in FIG. 1, the user simply releases the hook and pile fabrics 90 on the seat and skirt panels 18, 20 and folds these panels 18, 20 upwardly against the back panel 16. The side panel members 12, 14 may then be collapsed into their flat configuration and folded over the back panel 16. The resulting collapsed structure then has a total thickness which is on the order of about one inch. Assembly of the chair 10 simply reverses the steps above, i.e. unfolding the structural side panels 12, 14, popping the panels 12, 14 out to their expanded condition, lowering the seat panel 18, and skirt panel 20, and securing the seat panel 18 and skirt panel 20 in place with the hook and pile fabrics 90.

While the panel members 12, 14 are specifically described as being useful in the construction of furniture, it is contemplated that similar frameless, self-supporting panel members could be used to construct a variety of other different types of articles of furniture, such as waste baskets, tables, tunnels and forts for use by children, space division panels. Even further still, panels of the type described herein could be used in the construction of other ready to assemble items, such as splints for emergency use, containers, and literally anything else which might require a structural support member which has strength in longitudinal compression. As stated above, the length, width and thickness of the panels is not limited by the present description, the panels being adaptable to rectangular, triangular, pentagonal, octagonal and limitless other configurations.

It can therefore be seen that the instant invention provides a novel, ready to assemble furniture construction which is aesthetically pleasing when assembled, simple to manufacture, inexpensive to manufacture, and simple to assemble on-site without the aid of any tools. The key feature of the present system comprises a frameless, yet self-supporting structural panel member which expands and collapses simply by pressing on selected living hinges which are integrally formed in the panels. The selectively placed living hinges on the sheets of the panel members allow the panel to bend in a predefined configuration which is easily expanded and collapsed in a matter of seconds. The curved living hinges extending between the body portion and edge portions operate to lock the structure in complementary self-supporting tension and compression to automatically maintain the shape of the structure wherein the resulting structure has tremendous strength in longitudinal compression despite the absence of any frame structures. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A frameless, self-supporting panel member for use in an article of construction, said panel member comprising first and second like-shaped flexible sheets, said sheets having generally linear, outer peripheral edges, said sheets being arranged in aligned overlying relation, said outer peripheral edges of said sheets being secured together to form a flat panel member, said sheets each having an arcuate, inwardly curved, living hinge extending along the length of each peripheral edge thereof, said arcuate living hinges dividing said sheets into a central body portion and a plurality of edge portions, said edge portions being substantially planar extensions of said central body portion extending between the living hinges and the outer peripheral edges of the sheets, said panel member being movable between a flat, collapsed condition wherein said sheets are maintained in face-to-face adjacent relation, and an expanded, self-supporting volumetric condition wherein said central body portions of said sheets are flexed into a convex shape and maintained in spaced apart relation by adjacent hinged edge portions which are flexed inwardly into a generally concave shape and extend generally perpendicular to said central body portions, said panel member being movable from said flat condition to said expanded condition by exerting an inward pressure on said peripheral edges of said panel member, said sheets bending along said arcuate living hinges whereby said living hinges operate to place and maintain the adjacent hinged edge portions of the panel member in complementary, self-supporting tension and compression.

2. In the panel member of claim 1, said sheets comprising an inner core layer of flexible sheet material sandwiched between two outer layers of a covering material.

3. In the panel member of claim 2, said inner core layer being divided along said living hinges into a separate central body portion and edge portions which are aligned in mating relation, said central body portion and said edge portions being sandwiched between said outer layers of said covering material, said covering material being seamed between and around each portion of said inner core layer to form said living hinges between said central body portion and said edge portions.

4. In the panel member of claim 3, said inner core layer comprising plastic sheet material.

5. In the panel member of claim 4, said covering material comprising fabric.

6. In the panel member of claim 3, said covering material comprising fabric.

7. In the panel member of claim 2, said inner core layer comprising a flexible plastic sheet material.

8. In the panel member of claim 3, said covering material comprising fabric.

9. In the panel member of claim 2, said covering material comprising fabric.

10. In the panel member of claim 1, said sheets comprising an inner core layer of a fabric material sandwiched between two outer covering layers of a flexible sheet material.

11. In the panel member of claim 10, said outer covering layers comprising a flexible plastic sheet material.

12. An article of construction comprising a plurality of frameless, self-supporting panel members connected together to define a predetermined structural configuration, each of said panel members comprising first and second like-shaped flexible sheets, said sheets having generally linear, outer peripheral edges, said sheets being arranged in aligned overlying relation, said outer peripheral edges of said sheets being secured together to form a flat panel member, said sheets each having an arcuate, inwardly curved, living hinge extending along the length of each peripheral edge thereof, said arcuate living hinges dividing said sheets into a central body portion and a plurality of edge portions, said edge portions being substantially planar extensions of said central body portion extending between the living hinges and the outer peripheral edges of the sheets, said panel member being movable between a flat, collapsed condition wherein said sheets are maintained in face-to-face adjacent relation and an expanded, self-supporting volumetric condition wherein said central body portions of said sheets are flexed into a convex shape and maintained in spaced apart relation by the adjacent hinged edge portions which are flexed inwardly into a generally concave shape and extend generally perpendicular to said central body portions, said panel member being movable from said flat condition to said expanded condition by exerting an inward pressure on said peripheral edges of said panel member, said sheets bending along said arcuate living hinges whereby said living hinges operate to place and maintain the adjacent hinged edge portions of the panel member in complementary, self-supporting tension and compression.

13. In the article of construction of claim 12, said sheets comprising an inner core layer of flexible sheet material which is sandwiched between two outer layers of a covering material.

14. In the article of construction of claim 13, said inner core layer comprising plastic sheet material.

15. In the article of construction of claim 14, said covering material comprising fabric.

16. In the article of construction of claim 13, said covering material comprising fabric.

17. In the structural support member of claim 13, said inner core layer being divided along said living hinges into a separate central body and edge portions which are aligned in mating relation, said central body portion and said edge portions being sandwiched between said outer layers of said covering material, said covering material being seamed between and around each portion of said inner core layer to form said living hinges between said central body portion and said edge portions.

18. In the article of construction of claim 17, said inner core layer comprising plastic sheet material.

19. In the article of construction of claim 18, said covering material comprising fabric.

20. In the article of construction of claim 17, said covering material comprising fabric.

21. In the structural support member of claim 12, said sheets comprising an inner core layer of a fabric material sandwiched between two outer covering layers of a flexible sheet material.

22. In the structural support member of claim 21, said outer covering layers comprising a flexible plastic sheet material.

23. A ready to assemble furniture construction comprising a generally planar support member, and at least two frameless, self-supporting panel members for supporting said support member above a supporting surface, each of said panel members comprising first and second like-shaped flexible sheets, said sheets having generally linear, outer peripheral edges, said sheets being arranged in aligned overlying relation, said outer peripheral edges of said sheets being secured together to form a flat panel member, said sheets each having an arcuate, inwardly curved, living hinge extending along the length of each peripheral edge thereof, said arcuate living hinges dividing said sheets into a central body portion and a plurality of edge portions, said edge portions being substantially planar extensions of said central body portion extending between the living hinges and the outer peripheral edges of the sheets, said panel member being movable between a flat, collapsed condition wherein said sheets are maintained in face-to-face adjacent relation and an expanded, self-supporting supporting volumetric condition wherein said central body portions of said sheets are flexed into a convex shape and maintained in spaced apart relation by the adjacent hinged edge portions which are flexed inwardly into a generally concave shape and extend generally perpendicular to said central body portions, said panel member being movable from said flat condition to said expanded condition by exerting an inward pressure on said peripheral edges of said panel structure, said sheets bending along said arcuate living hinges whereby said living hinges operate to place and maintain the adjacent hinged edge portions of the panel member in complementary, self-supporting tension and compression.

24. The furniture construction of claim 23 wherein said support member comprises a seating panel for receiving a person in a seated position, said panel members supporting said seating panel in a fixed position above a supporting surface.

25. The furniture construction of claim 24 wherein said seating panel is secured to the panel members with strips of hook and pile fabric attached in corresponding relation on the seating panel and the panel member.

26. In the furniture construction of claim 23, said sheets comprising an inner core layer of flexible sheet material sandwiched between two outer layers of a covering material.

27. In the furniture construction of claim 26, said inner core layer comprising plastic sheet material.

28. In the furniture construction of claim 27, said covering material comprising fabric.

29. In the furniture construction of claim 26, said covering material comprising fabric.

30. In the structural support member of claim 23, said sheets comprising an inner core layer of a fabric material sandwiched between two outer covering layers of a flexible sheet material.

31. In the structural support member of claim 30, said outer covering layers comprising a flexible plastic sheet material.

32. In the furniture construction of claim 23, said inner core layer being divided along said living hinges into a separate central body portion and edge portions which are aligned in mating relation with the main body portion, said main body portion and said peripheral edge portions being sandwiched between said outer layers of covering material, said covering material being seamed between and around each portion of said inner core layer.

33. In the furniture construction of claim 32, said inner core layer comprising plastic sheet material.

34. In the furniture construction of claim 33, said covering material comprising fabric.

35. In the furniture construction of claim 32, said covering material comprising fabric.

* * * * *